US005289700A

United States Patent [19]

Cheng

[11] Patent Number: 5,289,700

[45] Date of Patent: Mar. 1, 1994

[54] SLIDABLY ADJUSTABLE EARRING POST

[75] Inventor: Mark Cheng, San Francisco, Calif.

[73] Assignee: Peony Fine Jewelry, Inc., San Francisco, Calif.

[21] Appl. No.: 48,156

[22] Filed: Apr. 15, 1993

[51] Int. Cl.[5] ..... A44C 7/00

[52] U.S. Cl. ..... 63/12

[58] Field of Search ..... 63/12, 14.1; 24/499, 24/609; D11/40, 41

[56] References Cited

U.S. PATENT DOCUMENTS 4,682,477 7/1987 Vaillancourt ..... 63/12

4,854,132 8/1989 Blumkin et al. ..... 63/12

4,993,240 2/1991 Pounder ..... 63/12

5,123,264 6/1992 Simmons ..... 63/12

5,181,397 1/1993 Battista ..... 63/12

*Primary Examiner*—Michael Milano

*Attorney, Agent, or Firm*—Charles E. Townsend, Jr.

[57] ABSTRACT

An earring for pierced ears including a post that is slidably mounted in a vertical slot on the main body or frame of the earring so that the main frame, and the ornamentation carried thereon can be adjusted upwardly or downwardly in reference to the ear lobe and the post projecting therethrough.

4 Claims, 1 Drawing Sheet

SLIDABLY ADJUSTABLE EARRING POST

BACKGROUND OF THE INVENTION

This invention relates to an improved earring construction, and particularly, to a slidably adjustable earring post for users with pierced ears.

1. Field of the Invention

Reference is made to my co-pending patent application Ser. No. 07/717,282, now U.S. Pat. No. 5,271,032 entitled Adjustable Earring Post wherein the advantages of providing a means for adjustably raising and lowering an earring relative to the lobe of a pierced ear is explained.

2. Description of the Relevant Prior Art

As explained in my co-pending application conventional earrings for mounting to pierced ears consist basically of a frame to which is rigidly and immovably mounted an inwardly projecting post to project through the pierced lobe in conjunction with a suitable locking device for mounting on the inner end of the post after it is projected through the pierced lobe. The locking device functions to prevent the post from slipping or falling out of the lobe during ordinary wear.

According to conventional design, the post is fixed in one location to the back of the main body or frame of the earring. From this fixed location, the post projects generally perpendicularly inwardly for projection through the pierced ear lobe. Because of both the fixed location of the post, and its fixed perpendicular angularity in reference to the vertical plane of the body or frame of the earring, the same earring may properly fit or "hang" from one person's ear lobe but not from another's. The reasons for this are that all ear lobes are of different shapes, sizes and dimensions, and that the pierced post receiving hole of one person may be located much higher or lower on the ear lobe than the location of the hole in the lobe of another person making desirable the ability to move the earring display relatively up or down in reference to the lobe. Also, people's lobes depend downwardly from the ear at different angles of vertical inclination making up or down adjustment desirable.

SUMMARY OF THE INVENTION

A principal object and advantage of the present invention is to provide an earring for pierced ears of a type in which the main frame carrying the display side or ornament overlies, or partially overlies the user's ear lobe and in which means are provided for slidably mounting the frame relative to the post in such way that the frame, supporting the ornamentation, can be moved upwardly or downwardly relative to the fixed axis of the post and releasably locked in any desired position which most attractively custom fits the particular ear lobe from which it is suspended.

In my co-pending application, it is possible to position the display side of an earring vertically relative to the ear lobe by alternatively affixing the earring post in any one of several vertically spaced post receptors (as by alternately screwing the threaded end of a post into one of several complementally female threaded holes in the frame of the earring). The present invention is an improvement in that within the finite length of the vertical slot or slideway in which the post is mounted, the exact positioning of the post is not limited by the number (e.g., three) of spaced receptors. Rather, the post of the present invention can be locked in any precisely desired position within the slideway;

Further, the present invention does not require that the post and the frame or body of the earring proper ever be physically separated from each other. In this connection, the adjustable post of my co-pending application requires that it be physically removed from one receptor and placed into another, which creates the possibility at least of a user accidentally dropping and losing the post or finding it physically difficult because of poor eyesight or otherwise to exactly align and insert the post properly in an alternatively selected receptor.

Further objects and advantages of the present invention will become apparent upon reading the following specification and referring to the accompanying drawings in which corresponding parts are numbered similarly in each of the several views.

DETAILED DESCRIPTION OF THE PREFERRED EMBODIMENT

Figure 1:
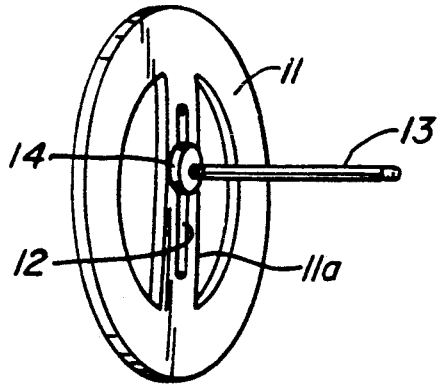
FIG. 1 is a perspective view of the back side of a main body or frame of an earring embodying the invention.

Referring more particularly to the drawings, FIG. 1 shows a main body or support frame 11 (some times hereinafter also referred to as a perimeter frame) and which includes a vertically disposed solid center piece or portion 11(a) which, in turn, is formed with an elongate vertical slot 12 of substantially constant width. FIG. 1 further shows a post 13 supported by lock nut 14 in a manner to be described more fully.

Figure 2:
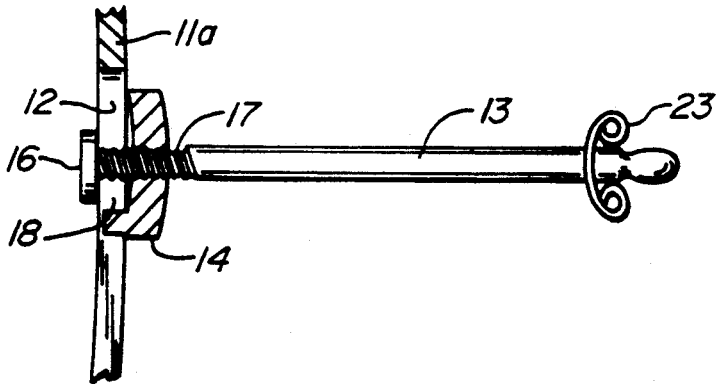
FIG. 2 is an enlarged fragmentary vertical sectional view of the earring frame formed with a vertical slot in which is slidably mounted the base threader end portion of a post.

Referring more specifically to FIG. 2, post supporting and locking means are disclosed as comprising a stop member 16 of larger diameter than the width of the slot 12 and which is permanently affixed to the base end of post 13. The base end extremities of post 13 are threaded as at 17 for engagement with complementally threaded lock nut 14. Lock nut 14 is provided with a lug 18 of slightly less width than the constant width of the slot and which functions as a sliding anti-rotation key within slot 12. The threaded base end portion of post 13 is also of slightly smaller diameter than the constant width of the slot 12 whereby the base end of the post can be slid up and down the vertical slot 12 and releasably clamped or locked in any desired position by rotating post 13 around its own axis to cause the lock nut 14 to tighten or loosen and thereby clamp or unclamp the solid margins of center portion 11(a) defining the vertical slot between the stop 16 and the lock nut 14. Whether the complemental threads on the post and nut are turned right handed or left handed is a matter of the manufacturer's choice.

Figure 3A:
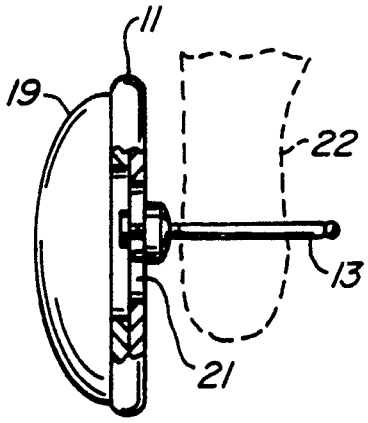
FIGS. 3A, 3B and 3C are identical vertical side elevational views of an earring (with portions of the frame broken away in section) having a gem stone, and which show the post releasably locked in intermediate, low, and high positions within the slot.

FIG. 3A discloses the earring construction of FIGS. 1 and 2 with an ornamentation or gem stone 19 anchored by any suitable and conventional means to the outer perimeter frame 11, and in such manner that a hollow space or gap 21 is left between the stop 16 and the anchored, base of the ornamentation 19 whereby the perimeter frame 11 carrying the ornamentation 21 can be moved freely up and down without the stop interfering with such up and down movement.

FIG. 3A also shows the outline (in phantom lines) of a pierced left ear lobe 22 through which the post 13 has been projected for securement by a conventional spring loaded slip-on type clip or lock washer 23 as illustrated in FIG. 2.

Figure 3B:
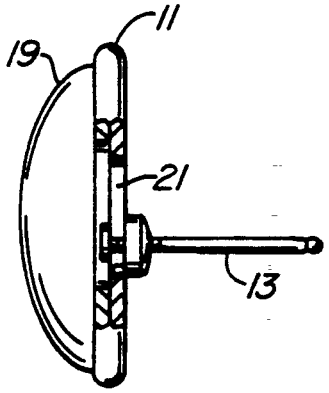
Figure 3C:
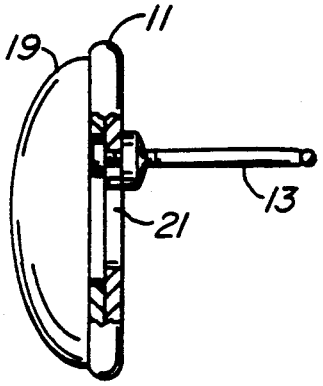

FIGS. 3A, 3B and 3C show how the frame 11 carrying the ornamentation 19 can be adjusted upwardly or downwardly in reference to the pierced ear lobe and post extending there through. The individual wearer or jeweler fitting the earring to the individual can thus adjust the ornamentation upwardly or downwardly to a position which most becomes and adapts to the particular user's ear.

Although the present invention has been described in some detail by way of illustration and example, it is understood that the scope of the invention is limited only by the scope of the appended claims.

What is claimed is:

1. An adjustable earring comprising:

a perimeter frame having an inner side and an outer display side;

a post of preselected diameter having a base end an a free end to penetrate through a pierced ear of a user;

an elongate slot formed completely through said perimeter frame extending in a substantially up and down vertical direction when said earring is mounted to a wearer's pierced ear;

said slot having a constant width slightly larger then the pre-selected diameter of said post;

the base end of said post projecting slidably through said slot to permit said post to be slidably and adjustably moved up or down to any pre-selected vertical position in said slot;

and adjustable mechanical clamping means including two complementary coacting clamping elements of larger dimension than the width of said slot mounted adjacent the base end of said post on opposite sides of said slot operable to permit releasable clamping of said two clamping elements against opposite sides of said frame, whereby said post can be clamped in any pre-selected position within said slot.

2. The combination of claim 1 and wherein said clamping means comprises complementary threaded parts to releasably clamp and lock said post in any desired pre-selected position within said slot.

3. The combination of claim 1 and wherein said clamping means comprises a stop member of larger diameter than the width of the slot mounted on the inner end of said post to prevent longitudinal withdrawal of the base end of the post from its location within the slot;

the base end portion of said post immediately adjacent said slot being formed with male threads;

a complementary female threaded nut threadedly engageable with the threaded portion of said post;

the co-action between the threaded post and nut being such that when the post is rotated about its own axis in a first direction the nut will contact the clamp margins of said frame defining said slot against the stop member to clamp the post in any preselected vertical position within the slot;

said co-acting threaded parts also operable to unloosen the nut from its clamping position when the post is axially rotated in an opposite direction.

4. The combination of claim 3 and wherein a lug is mounted on said nut extending slidably into said slot to prevent the nut from rotating with the post when said post is axially rotated in either direction.

* * * * *